United States Patent [19]

Schreder

[11] 4,303,295

[45] Dec. 1, 1981

[54] CONNECTOR FOR ELECTRIC CABLES

[75] Inventor: Felix Schreder, Oberderdingen, Fed. Rep. of Germany

[73] Assignee: E.G.O. Elektro-Gerate Blanc u. Fischer, Oberderdingen, Fed. Rep. of Germany

[21] Appl. No.: 102,502

[22] Filed: Dec. 11, 1979

[30] Foreign Application Priority Data

Dec. 18, 1978 [DE] Fed. Rep. of Germany ... 7837478[U]

[51] Int. Cl.[3] ..... H01R 4/36

[52] U.S. Cl. ..... 339/92 R; 339/176 R; 339/272 A; 339/276 T

[58] Field of Search ..... 339/92 R, 97 C, 95 R, 339/272 R, 272 A, 223 R, 276 T, 176 R

[56] References Cited

U.S. PATENT DOCUMENTS

| | | | |
|---|---|---|---|
| 2,908,887 | 10/1959 | Broske | 339/223 R |
| 3,234,321 | 2/1966 | Logan et al. | 339/223 R |
| 3,430,191 | 2/1969 | Hembrock | 339/223 R |
| 3,622,954 | 11/1971 | Hovnanian et al. | 339/223 R |
| 3,808,588 | 4/1974 | McGregor | 339/276 T |
| 3,831,132 | 8/1979 | Bowden, Jr. et al. | 339/223 R |

FOREIGN PATENT DOCUMENTS

| | | | |
|---|---|---|---|
| 691560 | 5/1953 | United Kingdom | 339/272 A |

*Primary Examiner*—John McQuade

*Attorney, Agent, or Firm*—Steele, Gould & Fried

[57] ABSTRACT

A sheet metal connector for the end of an electric cable having a wire conductor, the connector comprising: a first connecting end portion surrounding the end of the conductor and forming an end sleeve; a portion extending laterally from the first connecting end portion; and, an arm extending from the lateral portion and forming a second connecting end portion substantially parallel to the first connecting end portion, the arm and the lateral portion forming an L-shaped projection.

13 Claims, 6 Drawing Figures

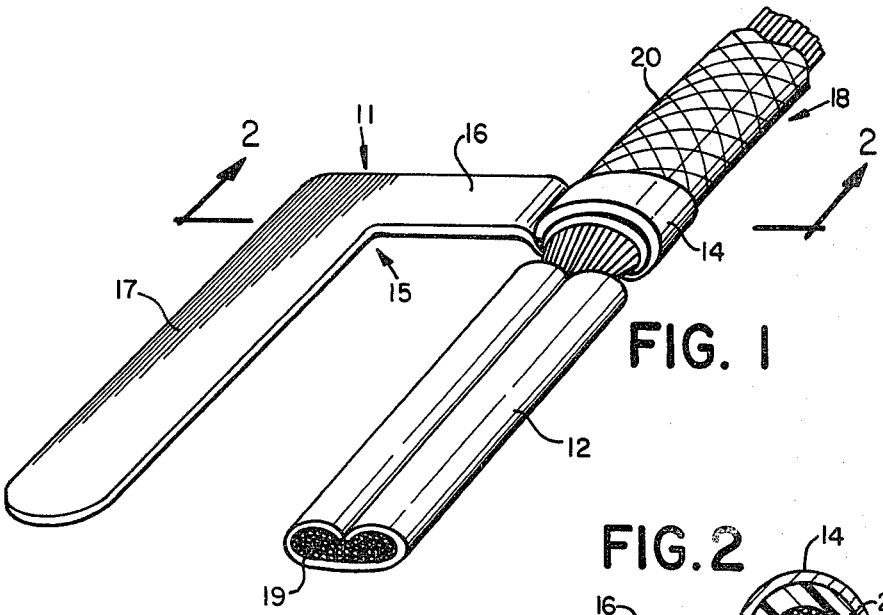
FIG. 1
FIG. 2
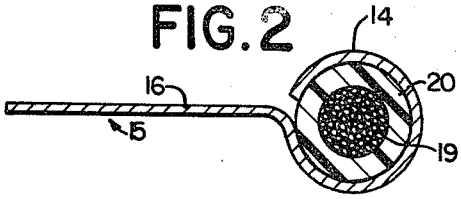
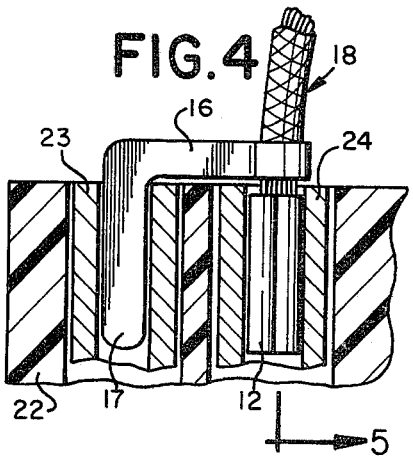
FIG. 4
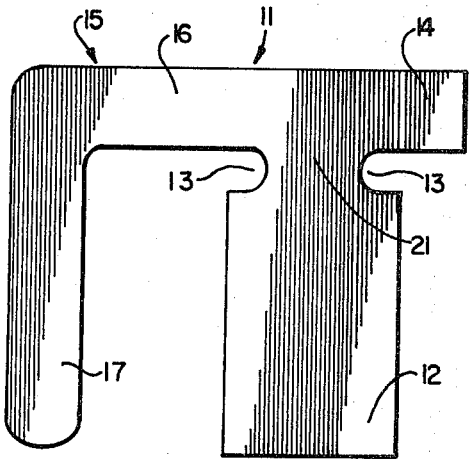
FIG. 3
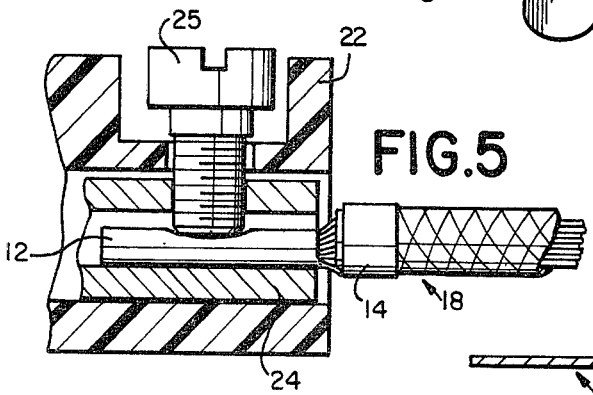
FIG. 5
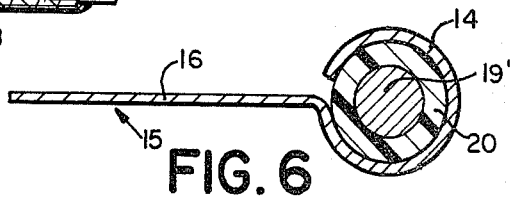
FIG. 6

CONNECTOR FOR ELECTRIC CABLES

BACKGROUND OF THE INVENTION

1. Field of the Invention

The present invention relates to a connector for electric cables, in particular for connecting electrical heating appliances, by means of which it is possible to connect one cable with two adjacent connecting sockets.

2. Prior Art

Nowadays, electrical heating appliances, in particular electric cooker plates, are usually connected either via connecting sockets having a screwed connection for making contact with the cable end, or via so-called AMP connections, in which case a connecting plug with a C-shaped cross-section located at the cable end is inserted by means of flat plug pins. Although the last-mentioned connection can be produced relatively quickly, it is not completely reliable, particularly at relatively high current intensities, since slight loosening can increase the transmission resistance and thus cause heating and burning of the contacts.

With all systems, it is difficult to produce a connection with two different sockets. A solution which has been proposed involves inserting sheet metal or wire bows into the socket together with one connecting end and then to secure it to the socket with a screwed connection. This leads to uncontrolled squeezing and the danger of loosening, which results in increasing the transmission resistance. In addition, there is invariably one more interface in the connection to the second connecting socket than to the first, so the transmission resistance is also increased.

With connections using flat plug pins, two connecting plugs have to be welded or soldered onto one cable if it is to be connected to two different flat plugs.

SUMMARY OF THE INVENTION

An object of the present invention is to provide a connector which allows a cable to be connected more simply with at least two connecting sockets.

According to the present invention there is provided a sheet metal connector for an electric cable having a wire conductor, the connector comprising a first connecting end portion surrounding the end of the conductor and forming an end sleeve; a portion extending laterally from the first connecting end portion; and, an arm extending from the lateral portion and forming a second connecting end portion substantially parallel to the first connection end portion, the arm and the lateral portion forming an L-shaped projection, the first and second connecting end portions, together with the lateral portion, forming a substantially U-shaped configuration. The connector is useful for both solid and stranded wire conductors.

The connector is thus formed by a simple end sleeve for the cable strands which is advantageously provided in any desired manner on a stranded cable, and the second connection is provided directly on the sheet metal member forming the end sleeve for the end sleeve for the strands, this being preferably stamped from the same sheet metal member so that transmission resistance is avoided.

The attachment can be molded at the end of the end sleeve for the strands remote from the free end thereof and can consist of flat sheet metal portions. It can project laterally from an insulation clamping tab surrounding the cable insulation. This insulation clamping tab is provided in conventional end sleeves for strands in any case so that the space needed for the connector is not increased by the second connection. Like the free arm of the attachment, the end sleeve for the strands is completely accommodated by the connecting sockets, while the connector can only extend slightly in the longitudinal direction of the cable between them and need not be wider in this direction than the insulation clamping tab. If the insulation clamping tab is compared with flat plug connections, about 15 mm is saved in the structural length and, when fitting electric heating appliances etc., this can substantially simplify assembly and make the appliances cheaper.

The invention is further described with reference to an embodiment of the invention which is illustrated in the accompanying drawings and is described in more detail below.

BRIEF DESCRIPTION OF THE DRAWINGS

FIG. 1 shows a perspective view of an embodiment of a connecting member according to the invention, FIG. 2 shows a cross-section along the line II—II of FIG. 1;

FIG. 3 shows a plan view of a sheet metal stamping for the connector illustrated in FIGS. 1 and 2;

FIG. 4 shows a connector with associated connection sockets;

FIG. 5 shows a section along the line V—V of FIG. 4; and,

FIG. 6 shows a view similar to FIG. 2, but with a solid wire conductor

DETAILED DESCRIPTION OF THE INVENTION

FIG. 3 shows a sheet metal stamping for a connector 11 consisting of for example, tin-plated or nickel-plated sheet brass. A projection which serves as an insulation clamping tab 14 is on one side of a substantially rectangular part of the blank which after constriction by two lateral indentations 13 provides an end sleeve 12 for the strands and on the other side is an L-shaped attachment 15 which is formed by a laterally offset connecting member 16 and a free arm which forms a second connecting end 17. The connecting end 17 runs parallel with the part forming the end sleeve 12 and its end is aligned with it, forming a blank having an overall U-shape.

The connector 11 in FIGS. 1 and 2 is shaped from a blank according to that shown in FIG. 3 when it is mounted on an electric cable 18. The cable consists of a metallic stranded wire conductor 19 and of an insulator 20 which can be composed for example, of fibreglass in the case of cables which are to be subjected to high thermal stresses. Before it is mounted, the blank shown in FIG. 3 is pre-shaped in such a way that the blank portion 12 forms the shape of a channel and also the portion 14 already points upwards. The insulated end of the cable is then surrounded by blank portion 12 so as to form the end sleeve 12 for the strands illustrated in FIG. 1, whose cross-section has the form of a flattened shape. This cross-section could also be described as a flat-oval with a seam tilted inwards on one of the flat sides.

The end sleeve 12 for the strands is connected with the other parts of the connector by means of a cross-member 21 formed between the indentations 13. The insulation clamping tab 14 is pressed round the terminal end of the insulation and secures it. In this process, the connecting member 16 also forms to a certain extent an abuttment for the insulation clamping tab 14, in that it kinks laterally to only about half the depth of the cable, as shown, in particular, in FIG. 2. The connecting member 16 and the second connecting end 17 remain undeformed and flat during the mounting operation in which process they lie approximately in the plane of the flat oval end sleeve 12. The free end of the connecting end 17 is rounded off. FIG. 6 illustrates the connector 11 as utilized with a cable having a solid wire conductor 19'.

FIG. 4 shows the mounting of a connector 11 in a component 22 made of insulating material which can be designed, for example, in the manner of an insulating screw joint. This is preferably a so-called connecting brick made of steatite for an electric cooker plate containing metal connecting sockets 23, 24. Although the connector 11 can also be used in conjunction with spring plug connections, it is preferably used in conjunction with screwed connections, this being the case in FIGS. 4 and 5. The end sleeve 12 for the strands and the second connecting end 17 are introduced into the sockets 23, 24 and each secured thereby by a screw 25 (FIG. 5). This has the advantage that the end sleeve 12 for the strands which only requires to be pressed round the stranded conductor 19 and not soldered or welded, receives additional contact pressure between the end sleeve for the strands and the stranded conductor due to the pressure for the screws 25. The second connecting end 17 is integral with the end sleeve 12 for the strands so no contact problems arise there. The connecting end 17 made of sheet metal adapts itself readily both to the opening in the connecting socket 23 and to the screwed end and thus forms good contact.

The distance between the end sleeve 12 for the strands and the second connecting end 17 determined by the length of the connecting member 16 is adapted to the respective distance between the two connecting sockets 23, 24. It should be noted that the structural height, i.e. the space needed in the longitudinal direction of the cable, is not greater than that required for a normal end sleeve for such strands. If the insulation clamping tab is omitted or is arranged in a different manner, two additional connecting ends could be connected integrally with the end sleeve for the strands.

It would also be possible to produce the attachment 15 from material which had been folded double, for which purpose, for example, the insulating clamping tab 14 is designed in such a way that it over-lies the attachment 15 once it has been folded thereover.

The connector according to the invention allows an electric cooker plate having three heating cables and four output connections to be connected particularly simply in such a way that all three heating cables are connected in parallel.

What is claimed is:

1. A sheet metal connector for the end of an electric cable having a wire conductor, the connector comprising:

a first connecting end portion surrounding the end of the conductor and forming an end sleeve;

a portion extending laterally from the first connecting end portion; and, an arm extending from the lateral portion and forming a second connecting end portion substantially parallel to the first connecting end portion, the arm and the lateral portion forming an L-shaped projection.

2. A connector according to claim 1, wherein the L-shaped projection joins the end sleeve at a point remote from the cable end, and comprises flat sheet metal portions.

3. A connector according to claim 1, wherein the cable has a stranded wire conductor.

4. A connector according to claim 3, wherein the sheet metal of the end sleeve has been pressed around the conductor strands in a configuration having a flat heart-shaped cross-section.

5. A connector according to claim 1, wherein the cable is insulated, and which further comprises an insulation clamping tab, extending laterally opposite the lateral portion, which surrounds the cable insulation.

6. A connector according to claim 5, wherein the L-shaped projection forms an abutment for the insulation clamping tab.

7. A connector according to claim 5, further comprising lateral indentations located so as to separate the L-shaped projection and the insulation clamping tab from the portion forming the end sleeve.

8. A connector according to claim 1, wherein the lateral portion of the L-shaped projection extends slightly in the longitudinal direction of the cable.

9. A connector according to claim 1, wherein the cable has a solid wire conductor.

10. A connector according to claim 1, adapted for connecting an electric heating appliance.

11. A connector according to claim 1, wherein the connector is adapted for connecting one cable with two adjacent connection sockets.

12. A connector for an electric cable having a wire conductor and a socket assembly therefor, comprising:

a sheet metal member, having: a first connecting end portion surrounding the end of the conductor and forming an end sleeve; a portion extending laterally from the first connecting end portion; and, an arm extending from the lateral portion and forming a second connecting end portion substantially parallel to the first connecting end portion, the arm and the lateral portion forming an L-shaped projection; and, a member having sockets adapted to receive the first and second connecting end portions and a clamping device for compressing the end sleeve, thereby improving electrical contact between the end sleeve and the conductor.

13. A connector and socket assembly according to claim 12, wherein the clamping device is a clamping screw.

* * * * *

UNITED STATES PATENT AND TRADEMARK OFFICE

CERTIFICATE OF CORRECTION

PATENT NO. : 4,303,295

DATED : December 1, 1981

INVENTOR(S) : Felix Schreder

It is certified that error appears in the above-identified patent and that said Letters Patent are hereby corrected as shown below:

At Column 1, line 50, delete "connection" and insert -- connecting --.

At Column 4, line 37 (Claim 10, line 2), after "connecting" insert -- the cable to --.

Signed and Sealed this

*Sixth* Day of *April 1982*

[SEAL]

*Attest:*

GERALD J. MOSSINGHOFF

*Attesting Officer*

*Commissioner of Patents and Trademarks*